United States Patent [19]

Tateno et al.

[11] Patent Number: 4,889,144

[45] Date of Patent: Dec. 26, 1989

[54] FILTER FOR TOBACCO SMOKING

[75] Inventors: Atsushi Tateno; Kimio Mashiko, both of Hiratsuka, Japan

[73] Assignee: Japan Tobacco Inc., Tokyo, Japan

[21] Appl. No.: 199,953

[22] Filed: May 26, 1988

[30] Foreign Application Priority Data

May 29, 1987 [JP] Japan ..... 62-131769

[51] Int. Cl.[4] ..... A24F 47/00

[52] U.S. Cl. ..... 131/337; 131/351; 131/335

[58] Field of Search ..... 131/331, 335, 337

[56] References Cited

U.S. PATENT DOCUMENTS 3,339,558 9/1967 Waterbury ..... 131/335
3,623,489 11/1971 Quinn ..... 131/335 X

FOREIGN PATENT DOCUMENTS 47-18638 5/1972 Japan .
48-23997 3/1973 Japan .

*Primary Examiner*—V. Millin
*Assistant Examiner*—Joe H. Chen
*Attorney, Agent, or Firm*—Nixon & Vanderhye

[57] ABSTRACT

Disclosed is a filter for tobacco smoking which comprises a filter tip having a space therein, with flavor-sealed particles being contained in the space. The flavor-sealing particles are composed of a natural polysaccharide, or its derivative, and diluent agent, and are destroyed, in order to release the flavor sealed therein, by the application of a force to the outer surface of the filter which is greater than a force normally applied to the filter in a smoking action. According to the present invention, the flavor sealed in the particles can be released without the particles being burnt at the time of smoking.

6 Claims, 2 Drawing Sheets

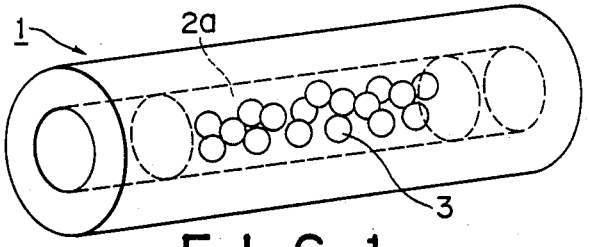
FIG. 1
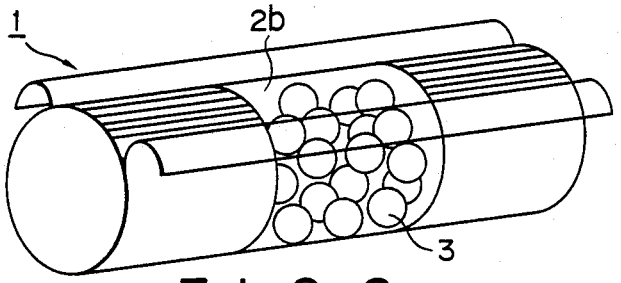
FIG. 2
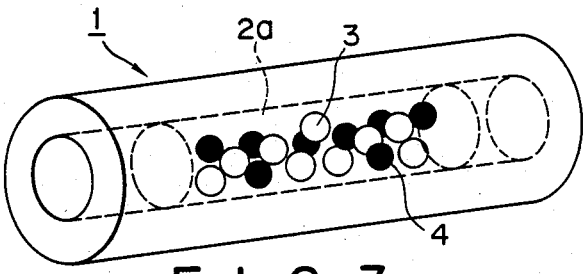
FIG. 3
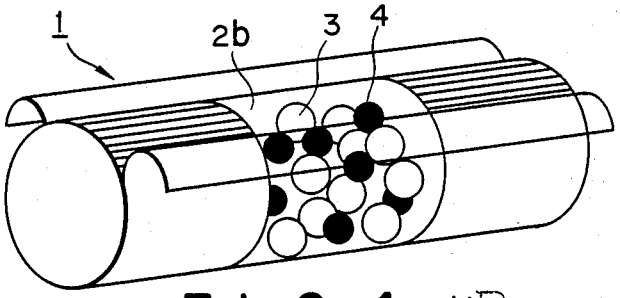
FIG. 4 A10

FILTER FOR TOBACCO SMOKING

BACKGROUND OF THE INVENTION

1. Field of the Invention

The present invention relates to a filter for tobacco smoking and, more specifically, to a flavor-containing filter.

2. Description of the Prior Art

Tobacco products generally contain one or more flavors as additives for enhancement of the smoking flavor. Flavors which are added to tobacco products are normally categorized into two groups; a primary flavor group for casing sources, and a secondary flavor group for top flavors. These flavors are often added to shredded tobacco by means of a direct spraying technique which takes place during the process of manufacturing cigars or cigarettes.

However, during the manufacturing process, many of the flavors of the secondary group are susceptible to volatilization and deterioration caused by heat and the surrounding air, which results in the flavoring being of reduced effectiveness. In addition, volatilization and deterioration of flavor can also occur during storage of the final product. In order to avoid such drawbacks, secondary flavors are often used in the form of inclusion in porous particles or of encapsulation in microcapsules, with the aim of protecting them against the effects of heat and air, and thus preventing volatilization and deterioration thereof.

Use of particles or microcapsules which contain or encapsulate flavors of the secondary group as additives to shredded tobacco, has been proposed in Japanese Patent Disclosure No. 48/23997. However, use of encapsuled flavors as described in the above cited patent disclosure is accompanied by a variety of problems which occur in the process of manufacturing tobacco products. These problems include the fact that a more complex method than spraying is required for adding the microcapsules, and that the added microcapsules tend to separate from shredded tobacco and generate dust. Moreover, use of encapsuled flavors as described in the above document entails drawbacks such as denaturation of the flavors due to the microcapsules being burnt at the time of smoking, and the generation of unpleasant smells as a result of the burning of the film materials constituting the microcapsules. Since these drawbacks pose unacceptable hazards in terms of the health of smokers, the method set forth in this disclosure has found no 20 practical applications to date.

SUMMARY OF THE INVENTION

It is therefore an object of the present invention to solve the problems associated with the prior technique as described above, by improving the method of use of the particles which contain secondary flavors.

According to the present invention, particles containing secondary flavor are enclosed, not in the tobacco section but in the tobacco filter section, and are destroyed prior to smoking, in order to release the flavor to the extent desired by the smoker.

More precisely, the above object of the present invention is achieved by providing a filter for tobacco smoking, which comprises a hollow filter tip in which are enclosed flavor-sealed particles which are destroyed, in order to release the flavor sealed therein, by the application of a force to the outer surface of the filter which is greater than a force normally applied thereto in a smoking action.

BRIEF DESCRIPTION OF THE DRAWINGS

FIGS. 1 to 4 respectively illustrate structures of four different embodiments of the filter for tobacco smoking according to the present invention, and FIGS. 5 and 6 respectively illustrate two different methods of using the tobacco smoking filter according to the present invention.

DETAILED DESCRIPTION OF THE PREFERRED EMBODIMENTS

Figure 5:
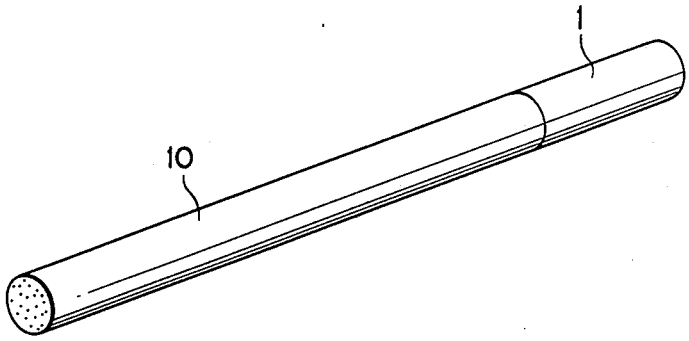

A flavor-sealed particle according to the present invention means a particle made of a purpose and powdery material which contains flavor sealed therein and which is prepared by use of an inclusion technique, or else is a microcapsule obtained by further coating such a particle. In any case, the flavor within the particle thus formed is almost completely protected against volatilization as a result of its sealed condition. While the flavor-sealed particles enclosed in the filter can be easily destroyed by means of a relatively weak force exerted by pressing or twisting it between a thumb and finger, they can not be destroyed by a normal smoking action where the filter is held between the smoker's fingers or lips. In order to assure easy destruction of the particles, the particle size should preferably be 1.8 to 5 mm, and more preferably, 2.5 to 5 mm in diameter.

Materials which can be used for such flavor-sealed particles, in which a flavor material is sealedly enclosed by use of an inclusion technique, include alginic acid, carboxymethyl cellulose (CMC) and other natural polysaccharides as well as their derivatives.

Flavor materials that can be used within a flavor-sealed particle according to the present invention are practically unlimited, although powdered flavors and oil-soluble flavors are preferable. Typical powdered flavors include licorice, kudzu, fenugreek, clove, menthol, Japanese mint, sage, anisseed, cinnamon and other herbs having a powder size between 1 and 5 $\mu$m. Typical oil-soluble flavors include lavender, cinnamon, cardamon, apium graveolens, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, cassia, ilang-ilang, sage, spearmint, fennel, piment, ginger, anise, coriander, and coffee. Each of the powdered or oil-soluble flavors can be used singly or mixed with others.

During the process of preparing flavor-sealed particles, an appropriate amount of diluent powder can be added to the natural polysaccharide or a derivative thereof and the above flavors, if required. Diluent agents which can be used for this purpose include powdered starch such as corn starch and potato starch, rice powder, calcium carbonate, diatomaceous earth, talc, acetate powder, and pulp flock. Use of such diluent agents has the following advantages:

First, any desired particle size can be obtained while maintaining the amount of the flavor content in a particle at a predetermined level. Secondly, a desired destruction strength of a flavor-sealed particle can be obtained by an appropriate choice of the diluent agent to be used; for instance, use of calcium carbonate as a diluent agent increases the hardness of the resulting particle, whereas choice of cellulose, rice powder or starch powder reduces the hardness. Thirdly, by using an appropriate diluent agent, the specific gravity of a flavor-sealed particle can be adjusted to a desired level; for example, use of calcium carbonate as a diluent agent increases the specific gravity of a particle, whereas choice of starch powder results in a contrary effect.

A filter tip for enclosing flavor-sealed particles according to the present invention may be prepared by arranging in parallel a certain amount of synthetic fibers such as polyacetate and polyester, or of natural fibers such as pulp and cotton, which are normally employed in conventional tobacco filters, and providing a space for enclosing the flavor-sealed particles therein. The space for enclosing these particles may be either narrow cylindrical space 2a formed coaxially within filter 1, as is shown in FIGS. 1 and 3, or broad and truncated space 2b formed at the middle section of filter 1, as is shown in FIGS. 2 and 4. The enclosing of flavor-sealed particles in space 2a or 2b can be easily accomplished by utilizing any of the known filter preparation techniques.

FIGS. 1 and 2 each illustrate one type of embodiment of the tobacco smoking filter according to the present invention. These embodiments each comprise a filter tip 1 having space 2 for enclosing flavor-sealed particles. The flavor-sealed particles may have a flavor content of only one type, or alternatively, may have flavor content made up of a mixture of two or more different types.

FIGS. 3 and 4 each illustrate another type of embodiment of the tobacco smoking filter according to the present invention, in which destruction-accelerator particles 4 are mixed with flavor-sealed particles 3 in order to accelerate the destruction of particles 3. For destruction-accelerator particles 4, any materials having a particle hardness greater than that of flavor-sealed particles 3 may be used. Suitable materials for destruction-accelerator particles include calcium carbonate, crystalline sugar, and crystalline table salt. Dummy particles prepared in a manner similar to flavor-sealed particles 3, but without flavor and having a greater hardness than particles 3, may also be used as destruction-accelerator particles, as can also fine particles of adsorbent materials such as active carbon.

Figure 6:
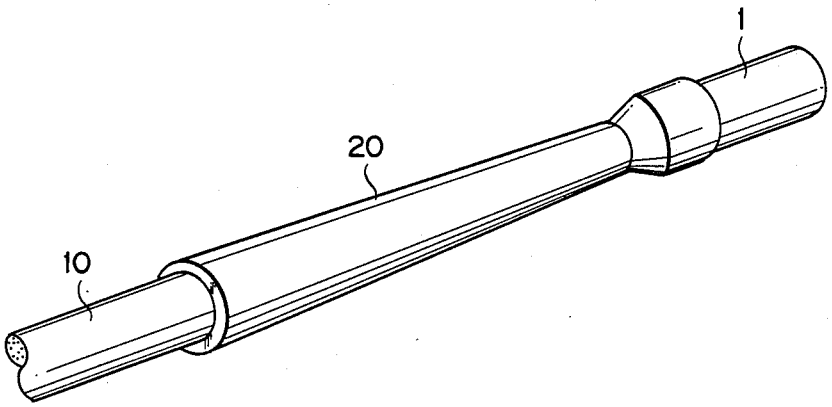

A filter for tobacco smoking may be used integrally with an ordinary cigarette, as is shown in FIG. 5. Alternatively, it may be attached to an end of a cigarette pipe 20, as is illustrated in FIG. 6. In either case, flavor-sealed particles 3 enclosed within the filter will be destroyed by being pressed or twisted by a finger and thumb action of the smoker at the time of smoking. This action of destruction releases the flavor sealed in particles 3, to the satisfaction of the smoker.

As described above, a tobacco smoking filter containing flavor-sealed particles according to the present invention can release its sealed flavor without burning any part of the flavor-sealed particles, hence without deteriorating its original flavor. Moreover, a tobacco smoking filter according to the present invention is free from any unpleasant smells that may be generated if the film and the solidifying materials used for preparation of the flavor-sealed particles are burnt. On the other hand, a smoker can enjoy only the original flavor of the tobacco when he smokes by using the filter without destructing the flavor-sealed particles enclosed in it. In other words, a tobacco smoking filter according to the present invention offers a smoker two alternative ways of enjoying a single cigarette.

Furthermore, when a tobacco smoking filter according to the present invention is applied to a cigarette in a manner as shown in FIG. 5, the flavor within flavor-sealed particles 3 enclosed in filter 1 will not be volatilized and dispersed to contaminate the surrounding areas so long as it is not destroyed. This means that cigarettes having flavors which are different from each other may be held in a single package without causing flavor contamination. Moreover, a mixture of two or more types of flavor-sealed particles respectively containing different flavor substances which, if mixed, may react each other to generate an unpleasant smell can be used without causing any undesired reaction.

Still another advantage of the present invention is that dummy particles and/or destruction-accelerator particles may be used as diluent to obtain a desired level of flavor density in a filter.

The present invention will be illustrated in greater details in the following description of examples.

EXAMPLE 1

Preparation of Flavor-Sealed Particles 0.6 parts by weight of sodium alginate having a 1% viscosity at 60 cp and 0.4 parts by weight of CMC having a 1% viscosity of 250 cp are added to 100 parts by weight of distilled water and the solid additives are dissolved in the water by stirring the mixture at 20° C. Then, 5 parts by weight of powdered calcium carbonate having a particle size between 1 to 10 μm, 20 parts by weight of corn starch and 1.5 parts by weight of L-menthol are added to the solution which is maintained at the same temperature as stated above and the additives are evenly dispersed. The dispersion solution is then slowly dropped through a nozzle (front end inner diameter 0.5 mm, outer diameter 1 mm) into 100 parts by weight of hardener solution (aqueous solution of calcium chloride having a concentration of 1% by weight) that has been prepared separately in advance and the drops of solution is treated in the hardener solution for 5 minutes to obtain spherical gel particles having a diameter of about 2.5 mm. Each of the obtained gel particles contains the flavor (L-menthol) that has been added. The gel particles are quickly washed with water, dried and then immersed in 0.3% by weight aqueous solution of sodium alginate having a 1% viscosity of approximately 300 cp for about 10 minutes. This operation causes a gel to be coated with calcium alginate gel having a thickness between 0.5 and 1 mm. The coating has the effect to sealedly encapsulate the L-menthol within the gel particle to form a L-menthol sealed capsule.

Preparation of a Flavor-Sealed Capsule Containing Filter

Space 2b provided at the middle portion of a filter tip 1 having a triple-filter structure as shown in FIG. 2 was filled with an appropriate amount of the flavor-sealed capsules obtained by the above described process to form a filter that contains menthol-sealed capsules.

Smoking Test

To use the filter in an application as shown in FIG. 5, the original filter of a commercially available cigarette (trade mark "Cabin") was replaced by filter 1 containing menthol-sealed capsules prepared in the above described operation. The cigarette was subjected to a smoking test which was conducted in a manner as described below.

When the cigarette was smoked in an ordinary manner, no flavor of menthol was released from the flavor-sealed capsules and the smoking taste was identical to that of any other "Cabin" cigarettes.

Then, the middle portion of the filter was slightly twisted with a thumb and a finger to destruct flavor-sealed capsules 3. When the cigarette was smoked after this action, a light flavor of menthol was sensed. After twisting the filter still further, a strong flavor of menthol was sensed during smoking the cigarette.

EXAMPLE 2

0.5 parts by weight of sodium alginate having a 1% viscosity of 60 cp are added to 50 parts by weight of distilled water and the additive is dissolved in the water by stirring the mixture at 20° C. Then 10 parts by weight of rice powder having a particle size between 350 and 420 μm and 2 parts by weight of L-menthol are added to the solution which is maintained at a constant temperature and the additives are evenly dispersed. The dispersion solution is then slowly dropped through a nozzle (front end inner diameter 0.5 mm, outer diameter 1 mm) into 100 parts by weight of hardener solution that has been prepared in advance and the drops of the dispersion solution is kept in the hardener solution for 10 minutes, thereby obtaining spherical gel particles having a diameter of about 2.5 mm. Each of the obtained gel particles contains the flavor (L-menthol) that has been added. The particles are quickly washed with water, dried and then immersed in 0.3% by weight aqueous solution of sodium alginate which has a 1% viscosity of 300 cp for 10 minutes. This operation causes the gel particles to be coated with calcium alginate gel having a thickness between 0.5 and 1 mm. The coating has the effect to sealedly encapsulate the L-menthol within the particle to form a L-menthol-sealed capsule.

Preparation of a Flavor-Sealed Capsule Containing Filter

A menthol-sealed capsule containing filter was prepared by using the flavor-sealed capsules obtained in the above process.

Smoking Test

A smoking test which is similar to that of Example 1 was conducted, thereby obtaining a similar test result.

EXAMPLE 3

15 menthol-sealed capsules that had been prepared in the same manner as described in Example 1 and 0.1 g of calcium carbonate particles having a diameter between 0.5 and 1.5 mm were mixed and the mixture was enclosed in a filter in a similar manner as described in Example 1 to from a filter as shown in FIG. 4.

The menthol-sealed capsule containing filter was used as a replacement of the filter of a commercially available cigarette "Cabin" as in Example 1 and a smoking test was conducted using the cigarette. When the middle section of the filter was lightly twisted, the capsules were destroyed with a force which is smaller than that of the case of Example 1, and when the cigarette was smoked thereafter, an effective release of menthol flavor was observed.

EXAMPLE 4

Preparation of Dummy Capsules 1.2 parts by weight of sodium alginate having a 1% viscosity of 60 cp are added to 100 parts by weight of distilled water and the additive is dissolved in the water by stirring the mixture at 250° C. Then, 7 parts by weight of calcium carbonate powder having a particle diameter of 1 to 10 μm and 3 parts by weight of starch powder are added to the solution (without adding any flavor substances) and the additives are evenly dispersed in the solution. The dispersion solution is then slowly dropped through a nozzle (front end inner diameter 0.5 mm, outer diameter 1 mm) into a hardener solution that has been prepared in advance (2% by weight water solution of calcium chloride). The solution drops are treated in the hardener solution for about 10 minutes to obtain spherical gel particles having a diameter of about 2.5 mm. The obtained gel particles are quickly washed with water, dried and at 50° C. for about one and a half hours in an air flow. In this way, dummy capsules with a diameter of about 1.5 mm containing no flavor are obtained. The capsules thus obtained show a hardness which is greater than that of the flavor-sealed capsules prepared in Example 1.

Smoking Test 10 of the dummy capsules prepared in the above process and 10 of the flavor-sealed capsules prepared in Example 1 were put together and the mixture was enclosed in a same filter tip employed in Example 1. The filter was then used in a commercially available cigarette "Cabin" as a replacement filter. In a smoking test, the flavor-sealed capsules were destroyed as easily as in the case of Example 3 and the flavor of L-menthol was effectively tasted.

It should be noted that the intensity of flavor could be altered by using a different ratio of mixture of dummy capsules to flavor-sealed capsules.

EXAMPLE 5

Preparation of Flavor-Sealed Capsules 10 parts by weight of cyclodextrin are evenly impregnated with 2 parts by weight of perilla oil and then 3 parts by weight of calcium carbonate powder (having a particle size of 1 to 10 μm) are mixed with the impregnated cyclodextrin to form a powder mixture. The mixture is then added to 100 parts by weight of 3% aqueous solution of carrageenan having a 1% viscosity of 180 cp, and the solution is stirred thoroughly for dispersion. The dispersion solution is then slowly dropped through a nozzle (front end inner diameter 0.5 mm, outer diameter 1 mm) into a hardener solution (aqueous potassium chloride solution of 2% by weight). The drops of the dispersion solution are treated in the hardener solution for about 10 minutes to obtain spherical gel particles having a particle diameter of about 2.5 mm. The obtained gel particles contain the flavor (perilla oil) that has been added earlier. The gel particles are then quickly washed with water, dried and then immersed in an aqueous carrageenan solution of 1% by weight (viscosity: 180 cp) for 5 minutes to have said gel particles coated with a carrageenan film with a thickness of about 1.5 mm. The obtained gel capsules sealedly contain perilla oil within themselves. The capsules are then washed with water and dried in an air flow at 40° C. for 2 hours to obtain perilla oil-sealed capsules having a diameter of about 4.0 mm.

Separately, 10 parts by weight of dextrin are evenly impregnated with 1 part by weight of Japanese mint oil to obtain Japanese mint oil-sealed capsules with a diameter of about 4.0 mm in a process which is identical with that of the perilla oil-sealed capsules as described above.

Preparation of Filter 5 of the perilla oil-sealed capsules, 5 of the Japanese mint oil-sealed capsules and 0.05 g of powdered active carbon (particle size between 1 and 2 mm) were mixed well to get an even mixture. The mixture containing flavor-sealed capsules was then enclosed in space *2b* of a filter tip having a triple filter structure as shown in FIG. 2, thereby forming a tobacco smoking filter containing flavor-sealed capsules according to the present invention.

Smoking Test

The filter obtained by the above preparation process was incorporated in a commercially available "Cabin" cigarette as a replacement filter. When the cigarette was smoked in a smoking test without destructing the flavor-sealed capsules, it gave a flavor which is identical with that of "Cabin". When the cigarette was smoked after destructing the capsules by switching the middle section of the filter, it gave a pleasant taste in which the flavor of perilla and that of Japanese mint are mixed.

What is claimed is:

1. A filter for tobacco smoking, comprising:

a filter tip having a space therein; and flavor-sealed particles contained in said space in the filter tip, said flavor-sealed particles being composed of a natural polysaccharide, or its derivative, and a diluent agent selected from the group including powdered starch such as corn starch and potato starch, rice powder, calcium carbonate, diatomaceous earth, acetate powder, and pulp flock, and being destroyed to release the sealed flavor, by application of a force to the outer surface of the filter which is greater than a force normally applied to the filter in a smoking action.

2. A filter for tobacco smoking according to claim 1, wherein said flavor-sealed particles of a plurality of flavor types containing different flavors are enclosed in said space.

3. A filter for tobacco smoking according to claim 1, wherein the size of said flavor-sealed particles is 1.8 to 5 mm in diameter.

4. A filter for tobacco smoking, comprising:

a filter tip having a space therein; and flavor-sealed particles contained in said space in the filter tip, said flavor-sealed particles being composed of a natural polysaccharide or its derivative, and a diluent agent, wherein said flavor-sealed particles are further coated with a natural polysaccharide or its derivative for encapsulation, and are destroyed to release the sealed flavor, by application of a force to the outer surface of the filter which is greater than a force normally applied to the filter in a smoking action.

5. A filter for tobacco smoking according to claim 4, wherein said flavor-sealed particles of a plurality of flavor types containing different flavors are enclosed in said space.

6. A filter for tobacco smoking according to claim 4, wherein the size of said flavor-sealed particlaes is 1.8 to 5 mm in diameter.

* * * * *